US006815136B1

(12) United States Patent
Zhao et al.

(10) Patent No.: US 6,815,136 B1
(45) Date of Patent: Nov. 9, 2004

(54) LIQUID DEVELOPERS AND PROCESSES THEREOF

(75) Inventors: Weizhong Zhao, Webster, NY (US); Thomas W. Smith, Penfield, NY (US); David H. Pan, Rochester, NY (US); William M. Prest, Jr., Webster, NY (US); Samuel Kaplan, Walworth, NY (US)

(73) Assignee: Xerox Corporation, Stamford, CT (US)

( * ) Notice: Subject to any disclaimer, the term of this patent is extended or adjusted under 35 U.S.C. 154(b) by 0 days.

(21) Appl. No.: 09/514,699

(22) Filed: Feb. 28, 2000

(51) Int. Cl.[7] ..... G03G 13/10
(52) U.S. Cl. ..... 430/117; 430/115
(58) Field of Search ..... 430/101, 112, 430/115, 117, 118, 119, 137.22; 399/239, 238, 237, 240, 250

(56) References Cited

U.S. PATENT DOCUMENTS

| | | | | | |
|---|---|---|---|---|---|
| 3,579,451 | A | | 5/1971 | Sclambi et al. | 252/62.1 |
| 3,939,087 | A | | 2/1976 | Vijayendran et al. | 252/61.1 |
| 4,019,911 | A | | 4/1977 | Vijayendran et al. | 106/23 |
| 4,052,325 | A | | 10/1977 | Santilli | 252/62.1 |
| 4,476,210 | A | | 10/1984 | Croucher et al. | 430/114 |
| 4,659,640 | A | | 4/1987 | Santilli | 430/119 |
| 4,737,432 | A | | 4/1988 | Tanaka et al. | 430/110 |
| 4,876,169 | A | | 10/1989 | Gruber et al. | 430/110 |
| 5,206,107 | A | | 4/1993 | Pearlstine | 430/115 |
| 5,254,424 | A | | 10/1993 | Felder | 430/112 |
| 5,254,427 | A | * | 10/1993 | Lane et al. | 430/137 |
| 5,304,451 | A | | 4/1994 | Felder et al. | 430/137 |
| 5,306,590 | A | | 4/1994 | Felder | 430/115 |
| 5,345,296 | A | * | 9/1994 | Wellings | 430/115 |
| 5,596,396 | A | | 1/1997 | Landa et al. | 399/237 |
| 5,698,616 | A | | 12/1997 | Baker et al. | 523/201 |
| 5,826,147 | A | | 10/1998 | Liu et al. | 399/237 |
| 5,937,248 | A | | 8/1999 | Liu et al. | 399/237 |
| 6,122,471 | A | * | 9/2000 | Liu et al. | 430/117 |

OTHER PUBLICATIONS

Exxon Product Information Bulletin for ISOPAR® H Fluid, Issue Date Nov. 23, 1998.*
Exxon Product Information Bulletin for ISOPAR® G Solvent, Issue Date Jul. 1, 1994.*

* cited by examiner

*Primary Examiner*—Janis L. Dote
(74) *Attorney, Agent, or Firm*—Eugene O. Palazzo, Esq.; Fay, Sharpe, Fagan, Minnich & McKee, LLP

(57) ABSTRACT

A process including:

dispersing a first liquid developer concentrate comprising a resin, a colorant, and a liquid developer reconstitution compound, in a carrier liquid, into additional carrier liquid to form a second liquid developer;

depositing the second liquid developer onto a liquid receiver member to form a developer cake;

developing an image with the developer cake;

reclaiming undeveloped developer cake from the cake bearing liquid receiver member; and redispersing the reclaimed undeveloped developer cake in the second developer liquid.

6 Claims, No Drawings

LIQUID DEVELOPERS AND PROCESSES THEREOF

REFERENCE TO COPENDING APPLICATIONS

Attention is directed to commonly owned and assigned U.S. application Ser. No. 09/182,786 filed Nov. 30, 1998, now U.S. Pat. No. 6,989,769 entitled "Liquid Developers and Processes Thereof"; and U.S. application Ser. No. 09/385,526 filed Aug. 30, 1999, now U.S. Pat. No. 6,060, 204 entitled "Liquid Developers and Processes Thereof".

The disclosure of the above mentioned patents and copending applications are incorporated herein by reference in their entirety. The appropriate components and processes of the disclosure may be selected for the inks and processes of the present invention in embodiments thereof.

BACKGROUND OF THE INVENTION

The present invention is generally directed to liquid toner and developer compositions and to imaging processes thereof. More specifically, the present invention relates to improved liquid developer compositions and improved development and imaging processes thereof arising from, for example, including an dispersion-redispersion promoting compound in the liquid developer. The present invention can provide, for example, improved image cake forming processes, improved image cake reconstitution processes, improved imaging processes, improved imaging apparatuses, and improved images.

In electrostatographic imaging processes liquid developers are commonly used. Conventional commercial liquid developers comprise, for example, a dispersion of a mixture of imaging particles including resin and pigment particles dispersed in a liquid hydrocarbon. Once the electrostatic latent image is formed on an imaging member, it can be transported, for example, through a bath of the liquid developer. When in contact with the liquid developer, the charged pigment particles in the liquid developer migrate to the electrostatic latent image and deposit thereon in conformance with the image. The imaging member may then be withdrawn from the liquid developer bath with the marking particles adhering to the electrostatic latent image in image configuration. A thin film of residual developer remains on the surface of the imaging member. In other liquid developer imaging processes there can be formed an intermediate image cake deposited, for example, on the latent image forming member or alternatively, on an intermediate transfer member which subsequently contacts a image forming member for selective developer transfer. The non-image or unused portion of the image cake is typically removed from the image forming member or the intermediate member and discarded.

A significant problem associated with prior art liquid developers, especially those concentrated liquid developers which are initially dispersed or "let-down" in a carrier liquid and then developed or deposited onto an intermediate or developer donor member and then only partially consumed in the given development-imaging cycle, is the inability to be readily recover and redisperse the unused developer material from the donor member for reuse in subsequent development-imaging forming cycles.

Another significant problem with these types of recovered and redispersed liquid developers is that they often do not or cannot redevelop properly and can result in poor development, image quality defects, and unnecessary waste or unusable developer. The foregoing problems are particularly pronounced for high speed liquid developer imaging processes where the amount of reclaimed and redispersed developer can be substantial. These and other problems are solved in embodiments of the present invention.

PRIOR ART

In U.S. Pat. No. 5,206,107, issued Apr. 27, 1993, to Pearlstine, there is disclosed a liquid developer that contains a liquid dispersion medium, marking particles, a polymeric surfactant, an optional colorant, and an optional charge control agent. The polymeric surfactant may be a siloxane surfactant, preferably a siloxane-alkene oxide block copolymer. To prepare the liquid developer, the surfactant may be added as a post additive to previously-formed developer.

In U.S. Pat. No. 5,698,616, issued Dec. 16, 1997, to Baker, et al., there is disclosed an organosol comprising a high molecular weight (co)polymeric steric stabilizer covalently bonded to an insoluble, high molecular weight thermoplastic (co)polymeric core which has the ability to form a three dimensional gel of controlled rigidity. The gel provides improved liquid ink or liquid electrophotographic or electrographic toner compositions by increasing sedimentation stability of the colorant, without compromising print quality or ink transfer performance. The gel is formed by manipulating the solubility parameter difference between the stabilizer and the solvent to achieve optimum performance of the dispersion.

In U.S. Pat. No. 5,306,590, Apr. 26, 1994, to Felder, there is disclosed a high solids replenishable electrostatic liquid developer concentrate that includes toner particles containing a carboxyl terminated polyester resin and a pigment, and a liquid toner dispersant. The solids content of the concentrate is above about 50%. A method for producing the concentrate includes the steps of blending particles containing a carboxyl terminated polyester and a pigment with a liquid toner dispersants to form a toner dispersant mixture and to increase the solids content of the toner dispersant mixture to more than about 90% solids. Toner solids in a liquid electrostatic developer are replenished by adding the toner particles to a toner solids depleted liquid electrostatic developer in a liquid electrostatographic printing machine.

In U.S. Pat. No. 5,254,424, issued Oct. 19, 1993, to Felder, there is disclosed a high solids replenishable electrostatic liquid developer concentrate which contains toner particles formed from a urethane modified polyester. This composition can be concentrated up to toner solids and subsequently sonicated to a working strength dilution.

In U.S. Pat. No. 5,304,451, issued Apr. 19, 1994, to Felder et al. there is disclosed a dry toner which is added to a liquid carrier to replenish a liquid developer in an electrostatographic printing machine.

In U.S. Pat. No. 4,659,640, issued Apr. 21, 1987, to Santilli, et al., there is disclosed a novel liquid electrographic developer containing a volatile, electrically insulating carrier liquid, polyester toner particles, and wax dispersed in the carrier is described. The wax-to-polyester weight ratio in the developer is sufficiently high, preferably above 0.25, thereby rendering the developer self-fixing at room temperature. A novel process for developing an electrostatic latent image on a smooth support using a self-fixing liquid developer is also described. Upon application of the developer to a latent image and evaporation of the liquid carrier from the image, the toner, aided by the wax at the indicated concentration level, is fixed to the surface without the need for externally applied heat.

In U.S. Pat. No. 4,052,325, issued Oct. 4, 1977, to Santilli, et al., there is disclosed a liquid developer containing redispersible, readily heat-fixable toner particles and a process for using the same. The developer is characterized by toner particles containing certain linear polyesters which are physically inert to the liquid carrier vehicle of the liquid developer and which, advantageously, have a melting point in the range of from about 40 to about 150 degrees C.

In U.S. Pat. No. 5,826,147, issued Oct. 20, 1998, to Liu, et al., there is disclosed a novel image development method and apparatus, wherein an imaging member having an imaging surface is provided with a layer of marking material thereon, and an electrostatic latent image is created in the layer of marking material. Image-wise charging of the layer of marking material is accomplished by a wide beam ion source such that free mobile ions are introduced in the vicinity of an electrostatic latent image associated with the imaging member having the layer of marking material coated thereon. The latent image associated with the imaging member causes the free mobile ions to flow in an image-wise ion stream corresponding to the latent image, which, in turn, leads to image-wise charging of the toner layer, such that the toner layer itself becomes the latent image carrier. The latent image carrying toner layer is subsequently developed and transferred to a copy substrate to produce an output document.

In U.S. Pat. No. 5,596,396, issued Jan. 21, 1997, to Landa, et al., there is disclosed an imaging apparatus including a first member having a first surface having formed thereon a latent electrostatic image, the latent electrostatic image including image regions at a first voltage and background regions at a second voltage, a second member charged to a third voltage intermediate the first and second voltages and having a second surface adapted for resilient engagement with the first surface and a third member adapted for resilient contact with the second surface in a transfer region. The imaging apparatus also includes apparatus for supplying liquid toner to the transfer region thereby forming on the second surface a thin layer of liquid toner containing a relatively high concentration of charged toner particles and apparatus for developing the latent image by the selective transfer of portions of the layer of liquid toner from the second surface to the first surface.

In U.S. Pat. No. 5,937,248, issued Aug. 10, 1999, to Liu, et al., there is disclosed a printing machine and method for efficiently forming toner images such that a quantity of unused toner applied to a photoreceptor of the machine is significantly diminished are provided. The printing machine and method include a movable photoreceptor having a photoconductive surface for supporting electrostatic charge; a first charging device for selectively charging only scattered portions of the surface of the photoreceptor; a liquid developer material supply and application apparatus for applying a coat of charged toner solids having a single polarity onto each charged selected scattered portion, thereby forming an image area patch of toner; an exposure device for image-wise exposing each charged selected scattered portion to form a first latent image therein; and a contact electrostatic printing (CEP) assembly including a conductive (CEP) roll and a bias source coupled thereto, for applying compressive and tensile forces to the image area centered patches of toner moving through an image processing nip formed by the photoconductive surface of the photoreceptor and the conductive CEP roll, wherein the bias source cooperates with a charge pattern of the image area centered patches of toner to generate image-wise electric fields within the image processing nip, and the image-wise electric fields together with the compressive and tensile forces, enable easy separation of background area toner solids from image area toner solids of the image area centered patches of toner, and onto the CEP roll; thereby resulting in an efficiently produced, quality toner image with significantly reduced non-development marking material generated and requiring removal.

In U.S. Pat. No. 4,476,210, to Croucher et al., there is disclosed a liquid developer comprising an amphipathic stabilizer polymer irreversibly anchored to a thermoplastic resin core of marking particles. The stabilizer has a soluble polymer backbone with an insoluble anchoring chain grafted onto the polymer backbone. The stabilizer may comprise an AB or ABA type block copolymer. The block copolymers may include siloxanes. The procedure for preparing the liquid developer comprises the steps of (1) preparation of the amphipathic stabilizer; (2) non-aqueous dispersion polymerization of the core monomer in the presence of the amphipathic stabilizer to provide stabilized particles; (3) dyeing of the non-aqueous dispersion particles; and (4) negatively charging the particles.

In U.S. Pat. No. 3,579,451, to Sciambi, there is disclosed a stable, dry developer composition concentrate comprising silicone intermediate resin and a cross-linking promoting catalyst. The dry concentrate can be made into a liquid concentrate. The silicone intermediate resin component is a toluene- or xylene-soluble, lower alkyl and/or phenyl substituted, cross-linkable siloxane resin. The liquid developer composition concentrate is prepared by (1) heating a mixture of silicone intermediate resin and a cross-linking promoting catalyst suspended in an aromatic organic carrier liquid; (2) admixing the resin-catalyst mixture with an insoluble solid pigment; (3) milling the resin-catalyst mixture and pigment together in a grinding mill; (4) evaporating the milled materials to dryness; and (5) milling the dry concentrate with an organic carrier liquid to produce a liquid developer concentrate containing submicron-sized catalyst particles.

In U.S. Pat. No. 4,737,432 to Tanaka et al., there is disclosed a positively chargeable toner and a dry developer comprising positively chargeable fine silica powder. The silica powder may be treated to enhance hydrophobicity with another silane coupling agent or with an organic silicon compound, including such agents as hexamethyldisiloxane, 1,3-divinyltetramethyldi-siloxane, 1,3-diphenyltetramethyldisiloxane, and dimethyl-polysiloxane having 2 to 12 siloxane units per molecule and containing each on hydroxyl group bonded to Si at the terminal units.

In U.S. Pat. Nos. 3,939,087 and 4,019,911, both to Vijayendran et al., there is disclosed liquid toner compositions comprising a silane treated fumed silica. The silane treated fumed silica is treated with an organosilicon compound in which some of the bonds of a silane linkage are substituted by saturated or unsaturated hydrophobic organic groups.

In U.S. Pat. No. 4,876,169 to Gruber et al., there is disclosed the use of siloxanes, in particular polydialkyl- and polydimethyl- siloxanes, incorporated in the backbone of a polymer resin in a dry toner or developer composition in conjunction with a release fluid additive which enables the toner to be free flowing and the toner particles not to agglomerate.

Liquid developer and related compositions and processes for their preparation are known, reference for example, U.S. Pat. Nos. 5,563,015, 5,565,299, 5,567,564, 5,382,492, 5,714,993, 5,570,173, and 5,612,777. Also of interest is: McCurry, "Contact Electrostatic Printing", IBM Tech. Discl. Journal, vol. 13, No. 10, March, 1971, pp. 3117–3118.

The disclosures of the aforementioned patents are incorporated herein by reference in their entirety.

There remains a need for liquid electrostatic toner and developer compositions and processes thereof which provide high quality and high resolution developed images over the entire range of known development and printing speeds, and for liquid developer concentrate compositions which are readily dispersible in liquid carrier vehicles and which dispersed liquid developers can be readily concentrated, recovered, and redispersed in the development process and within the developer housing if desired. A need also exists for liquid developers which provide good transfer efficiency, high resolution, print reproducibility, and print uniformity.

The developers and development processes thereof of the present invention are useful in many applications, including toners for use in electrophotographic imaging processes, such as digital printing and copying systems including color systems, and for use for example, in liquid marking, such as liquid electrostatic printing, ink jet printing applications, and offset printing inks and applications.

SUMMARY OF THE INVENTION

Embodiments of the present invention, include:

A process comprising:

dispersing a first liquid developer concentrate comprising a resin, a colorant, a carrier liquid, into additional carrier liquid to form a second liquid developer;

depositing the second liquid developer onto a liquid receiver member to form a developer cake;

developing an image with the developer cake;

reclaiming undeveloped developer cake from the cake bearing liquid receiver member; and redispersing the resulting reclaimed cake in the second developer liquid;

A liquid developer composition comprising: a concentrate of mixture of a resin, a colorant, a carrier liquid, and a liquid developer reconstitution compound; and A printing machine comprising:

an image receiver, a liquid developer housing, and a first liquid developer composition containing a liquid developer reconstitution compound; wherein the housing is adapted to reclaim undeveloped developer cake from the cake bearing liquid receiver member, and is adapted to redisperse the reclaimed undeveloped developer cake into the first developer liquid.

These and other embodiments of the present invention are illustrated herein.

DETAILED DESCRIPTION OF THE INVENTION

The developers and development processes of the present invention provide a simple and effective solution to the problem of dispersion and redispersion of liquid developer compositions and formulations in liquid development processes, for example, in liquid ink development printing systems which employ conventional liquid electrostatic toner or ink developer formulations or for those formulations used in contact electrostatic printing(CEP) processes.

The terms "redisperse," uredispersed," and "redispersion" as used herein collectively refer to, for example, reconstituting a working liquid developer from a concentrated reclaimed developer cake, involving at least one cycle, up to a multiplicity of cycles, where a cycle includes concentrating and diluting the developer cake or solids to achieve a liquid dispersion of the reclaimed cake of such quality that results in subsequent uniform and smooth cake formation.

Although not wanting to be limited by theory it is believed that the liquid developer redispersion or reconstitution compound or compounds contained in the liquid developers used in the liquid development processes of the present invention serve two fundamental functions. One function serves to form coatings of the redispersion compound on the surface of the resin particles to produce improved resin particle dispersion in the liquid carrier. A second function of the coating of the redispersion compound is to reduce inter-particulate attraction within the dispersion to reduce particle aggregation and related effects. The improved dispersion of particles means a small average particle size, or alternatively, greater particle size reduction can be achieved in a shorter period of milling time, and within a narrower particle size distribution. Smaller particles are generally more prone to re-agglomeration or flocculation. However, as a result of the reduction in inter-particulate attraction, this is not the case with redispersion or reconstitution compounds of the present invention. Developer dispersions of the present invention are significantly more stable against flocculation and agglomeration than those dispersions produced by conventional means.

An objective of dispersing particles in a dispersion or grinding medium by mechanical means, is to separate the particle agglomerates formed, for example, by hydrophilic aggregation such as during developer manufacture. The dispersion process can comprise, for example, three stages: 1) wetting of particles, such as in a pre-mixing stage, 2) separation of particles, such as by mechanical means, and (3) stabilization of particles, so as to overcome Van der Waals attractive forces. All three stages can be improved by the use of effective reconstitution compounds. As particle size is reduced, greater particle surface area is created and leads to an improvement in developed image optical properties, for example, image resolution.

Although not wanting to be limited by theory it is believed that reconstitution compounds of the present invention are preferably two-component or two-phase structures, that is, a first polymeric chain or back bone that is liquid substantive, that is compatible with the liquid component, and the compound's structure further includes a second chain or anchoring groups which are different from the first chain and wherein at least the second chain or anchoring groups are surface substantive with respect to the resin particles, that is compatible with and preferentially concentrating at the resin particle surface. This structural combination is believed to be responsible for the effectiveness of the reconstitution compounds of the present invention.

POLYMERIC CHAIN Although not wanting to be limited by theory it is believed that the nature of the polymeric chain is important to the performance of reconstitution compounds. If the chains are not sufficiently solvated, then they will collapse onto the particle surface allowing the particles to aggregate or flocculate. In order to meet the need for proper compatibility several different polymer chain types and combinations can be used as reconstitution compounds and to enable effective accommodation in a variety of carrier liquids that are typically encountered in common liquid developer formulations.

The molecular weight of the reconstitution compound is sufficient to provide polymer chain lengths to overcome Van der Waals forces of attraction between particles. If the chains are too short, then they will not provide a sufficiently thick steric barrier to prevent flocculation. There is generally an optimum polymer chain length over and above which the effectiveness of the stabilizing material ceases to increase. Indeed in some cases, molecules with longer than optimum chains can be less effective. Ideally the chains should be free to move in the dispersing medium. To achieve this, chains with anchor groups, for example, at one end of the polymer chain only, have shown to be the most effective and are preferred in providing steric stabilization.

ANCHOR GROUP(S)/SIDE CHAIN(S) The above mentioned polymer chains of the reconstitution compounds can contain a single chain or many hundreds of chains; indeed both types are available. Although not wanting to be limited by theory it is believed that the anchor group or side chain should preferably anchor to the resin or developer particle surface, and the surface of the particles be covered with a sufficient density of chains to ensure minimal particle-particle interaction. As the nature of the surface of particles differ depending, for example, on their chemical type, many different chemical groups are suggested as anchor groups for reconstitution compounds. Indeed reconstitution compounds can include several different types of anchor groups. These compounds vary in anchoring ability, for example, from compounds suitable only for certain particles such as those with substantially hydrophobic surface properties, to compounds suitable for the wide range of pigments with polar surfaces.

A key difference between reconstitution compounds of the present invention and conventional dispersion additives of the prior art formulations is that the reconstitution compounds provide higher dispersion stability at high developer concentration. This means there is a need for high Van der Waals repulsion at elevated operating concentrations. Another key difference is that since CEP developers require a concentration and re-dispersing cycle, at least some particles, must maintain good dispersion stability even after going through hundreds of cycles of reconcentration and re-dispersion. These and other problems are addressed and solved in the present invention.

The present invention in embodiments provides a process comprising:

dispersing a first liquid developer concentrate comprising a resin, a colorant, and a liquid developer reconstitution compound, in a carrier liquid, into additional carrier liquid to form a second liquid developer;

depositing the second liquid developer onto a liquid receiver member to form a developer cake;

developing an image with the developer cake;

reclaiming undeveloped developer cake from the cake bearing liquid receiver member; and redispersing the reclaimed undeveloped developer cake in the second developer liquid.

The development can be accomplished, for example, by contacting a photoreceptor article or an ionographic article that bears a latent image or charge image with the cake bearing member. The image to be developed with the developer cake is preferably a charge latent image formed on a photoactive member by a corona charger. In other preferred embodiments the development and imaging processes of the present invention can further comprise charging the developer cake on the a liquid receiver member by a corona charger prior to developing an image.

The reclaiming or reclamation of undeveloped developer cake from the cake bearing liquid receiver member, that is, removing the cake from the liquid receiver member with, for example, a scraper, a blade, and the like articles that can be in direct contact with the cake bearing liquid receiver member preferably occurs at a point beyond the point of image development.

The second liquid developer can be insulating or semiconductive, and preferably has dielectric character, for example, with a typical conductivity of from about 0.01 to about 50 pS/cm, and preferably from about 0.01 to about 5 pS/cm.

The development and imaging processes of the present invention can further comprise continuously monitoring or measuring the solids content or concentration of the second liquid develop in the developer sump with, for example, an electronic or optical sensor adapted for that purpose, reference for example commonly owned and assigned U.S. Pat. No. 5,713,062, to Goodman et al., issued Jan. 27, 1998, which discloses a system and method for color mixing control in an electrostatographic printing system, the disclosure of which is incorporated by reference herein in its entirety. An operative mixture of colored developing material can be continuously replenished with selectively variable amounts of developing materials of basic color components making up the operative mixture. The rate of replenishment of various color components added to the operative mixture is controlled to provide a mixture of developing material capable of producing a customer selectable color on an output copy substrate. A colorimeter can be provided for monitoring the color of a test image printed with the operative mixture of developing material in the supply reservoir so that the color thereof can be brought into agreement with a color required to produce the customer selectable output color. The present invention can be used to control and maintain the color of the operational mixture of developing material in the reservoir through continuous monitoring and correction in order to maintain a specified ratio of color components in the reservoir over extended periods associated with very long print runs. The invention may also be utilized to mix a customer selectable color in situ, whereby approximate amounts of primary color components are initially deposited and mixed in the developing material reservoir and resultant images printed with the developing material mixture are continually monitored and adjusted until the mixture reaches a desired color output.

The development and imaging processes of the present invention can further comprise maintaining, for example, by adjusting the solids content or concentration of the second liquid developer to a predetermined operational concentration range, by for example, redispersing portions of the reclaimed developer cake into the second developer to form reconstituted second developer. Where there is insufficient reclaimed developer cake to achieve the predetermined or preselected concentration range, then dispersing additional first liquid developer concentrate into the second liquid developer, or alternatively, for example when the image density or image coverage is too high adding additional carrier liquid to form a de novo second developer which is suitable for immediate use and imaging.

The development and imaging processes of the present invention can further comprise transferring the developed image to a second receiver substrate.

The reclamation or reclaim of the undeveloped developer cake can be accomplished with any suitable means, for example, with a blade cleaner that directly contacts the cake bearing liquid receiver member. As suggested above, the reclaimed developer cake can be combined directly with either or both the first liquid developer, that is, the concentrate or the second liquid developer, that is, the working developer composition. Alternatively, the reclaimed developer cake can be kept separated from the second liquid developer until the solids content of the second liquid developer drops below, for example, from about 6 to about 10 weight percent at which time the separated reclaimed cake can be added back to the second developer in various amounts to achieve a preferred dispersed solids content for the working developer.

The present invention, in embodiments, provides liquid developer compositions comprising: a concentrate of mixture of a resin, a colorant, a carrier liquid, an optional charge acceptance agent, and a liquid developer reconstitution compound as illustrated herein.

The liquid developer reconstitution compound can be, for example, a polydimethylsiloxane containing copolymer with a weight average molecular weight of from about 1,000 to about 1,000,000.

The liquid developer reconstitution promoting compound can also be a compound or compounds selected from:

i) block copolymers of the formula poly(A-b-B), with a first lipophilic A block of poly(dimethylsiloxane) with a weight average molecular weight of from about 1,000 to about 1,000,000 which is compatible with hydrocarbon carrier liquid and with a second lipophobic B block, which is compatible with toner resin, formed for example from free radical polymerizable monomers for example, alkyleneoxides, such as ethyleneoxide, alkyl acrylates, including acids and esters, alkyl alkacrylates, such as methyl methacrylate, with a B block weight average molecular weight of from about 100 to about 100,000, and mixtures thereof; and wherein the B polymer segment can have hydrogen bonding capability or hydrogen bonding functional groups;

ii) grafted copolymers of the formula poly(A-g-B), with a continuous A polymer backbone with a weight average molecular weight of from about 1,000 to about 1,000,000 comprised of monomers of alkyleneoxides, alkyl acrylates, alkyl alkacrylates, and mixtures thereof, and grafted B polymer segments comprised of one or more poly(dialkylsiloxane) oligomer or polymer segments appended to the A backbone, the individual dialkylsiloxane units in the B segments can contain from 2 to about 20 carbon atoms, including methyl, ethyl, and the like structural group homologues and analogues, wherein each B segment has a weight average molecular weight of from about 100 to about 100,000, and wherein the grafting(g) of B segments on the A backbone is present in an amount of from about 10 to about 35 weight percent based on the total weight of the polymer; and preferably from about 15 to about 25 weight percent based on the total weight of the polymer, such as, poly(alkyl acrylates-g-dimethylsiloxane), poly(alkyl alkacrylates-g-dimethylsiloxane), and poly(ethyleneoxide-g-dimethylsiloxane);

iii) random copolymers with at least one hydrophilic segment which is attracted to or attaches to the surface of the resin particles and at least one hydrophobic segment that is capable of dispersing in the liquid, for example, poly(ethylene-isobutylene);

iv) random or blocked alkylene vinyl acetate copolymers, such as ethylene-vinyl acetate copolymers, of the formula poly(A-B), where A is from 1 to about 1,000 mers of alkylene, and B is from 1 to about 1,000 mers of vinyl acetate, for example, ELVAX® copolymers commercially available from DuPont;

v) nonionic surfactants, for example, SOLSPERSE® dispersants available from Avecia (formerly Zeneca), such as, SOLSPERSE® 17000, see for example <http://www.aveciapigments.com/additive/whatisol.htm#design >. Nonionic surfactants with a hydrophobe-lipophobe balance (HLB) values in the range of about 8 to about 24 are useful in the present application, and nonionic surfactants with an HLB in the range of from about 10 to about 20 are preferred. The HLB values were determined by the procedure of Becher, P. and Birkmeier, R. L., see *J. Am. Oil Chem. Soc.,* 41(1964):169.

The liquid developer reconstitution compound can be selected from functionalized polysiloxanes with a weight average molecular weight of from about 1,000 to about 1,000,000, including:

a) amine functionalized poly(dimethylsiloxane) polymers of the formula X—(A)—X where A is a polysiloxane and where X can be hydrogen, and one or both X groups can be an —$NR_3$ where R is independently selected from hydrogen, alkyl with from about 1 to about 18 carbon atoms, and aryl with from about 5 to about 18 carbon atoms, or amine pendant poly (dimethylsiloxane) polymers of the form (A)—Y—(A), where Y is a silicon atom with pendant alkylamine groups —RX, where R is an alkyl chain of length from 1 to about 10 carbon atoms and X is as described above;

b) hydroxy functionalized poly(dimethylsiloxane) polymers of the formula X—(A)—X where A is a polysiloxane, and where X can be hydrogen, and one or both —X can be an hydroxyl group(—OH) or hydroxy pendant poly(dimethylsiloxane) polymers of the formula (A)—Y—(A), where Y is a silicon atom with a pendant hydroxyl group (—OH);

c) zwitterionic poly(dimethylsiloxane) polymers of the formula X—(A)—Y where A is a polysiloxane, where X can be a cationic group, for example, a quaternized amine, and —Y can be an anionic group, for example, a carboxylate salt; and d) oligomeric polyalkylene oxide poly(dimethylsiloxane) polymers of the formula X—(A)—X where A is a polysiloxane, where X can be hydrogen, and one or both X can be, for example, a polyalkylene oxide segment of the formula $HO(—R—O)_m$-where R is a hydrocarbon with from 1 to about 18 carbon atoms, and m is from 1 to about 20, such as a poly(ethylene oxide) of the formula $HO(CH_2—CH_2—O)_m$-where m is from 1 to about 20.

The liquid developer reconstitution compound can be present in an amount of from about 0.1 to about 10 weight percent of the total solids content of the liquid developer as a concentrate composition, and preferably from about 0.2 to about 5 weight percent of the total solids content. The liquid developer can have a solids content of from about 5 to about 50 weight percent as a concentrate composition. The liquid developer can have a solids content, for example, from about 3 to about 20 weight percent as a working developer composition, preferably with a solids content of from about 5 to about 15 weight percent, and more preferably a solids content of from about 8 to about 10 percent.

In embodiments, the liquid developer reconstitution compound can provide a number of useful benefits and advantages including, for example: a stabilized and readily dispersible and redispersible developer concentrate; stabilized second liquid to developer particles; a stabilized developed cake; enhanced developer release from intermediate members or image members; and rapid redispersion of reclaimed developer particles in carrier liquids.

It is a particular advantage of the present invention that the reconstitution or redispersion compounds such as the polymeric surfactant may be added subsequent to the preparation of the toner, that is, as a post additive, and thus in a manner that does not require the toner to be remade in order to employ this additive.

The presence of redispersion compounds, such as a polymeric siloxane surfactant, in the developer formulation enables excellent transfer of an image. The polymeric surfactant of the present invention can be for example a poly(dialkylsiloxane), and preferably a siloxane-alkene oxide block polymer. Examples of the polysiloxanes selected for the surfactant polymers of the present invention include those disclosed in the aforementioned U.S. Pat. No. 5,206,107, the disclosure of which is incorporated by reference herein in its entirety.

A preferred block copolymer comprises blocks of dimethylsiloxane and ethylene oxide, for example, poly (dimethylsiloxane-b-ethylene oxide). The reconstitution compound, for example the aforementioned surfactants, can be employed in a concentration ranging of from 10 to 1,000 mg per gram of toner solids, and more preferably in the range of 100 to 500 mg per gram of toner solids.

The liquid developers of the invention may be made with any suitable dispersion medium. Nonpolar liquids useful as a dispersion medium are, preferably, branched-chain aliphatic hydrocarbons. These include, for example, ISOPAR®-G, ISOPAR®-H, ISOPAR®-K, ISOPAR®-L, ISOPAR®-M, and ISOPAR®-V. These hydrocarbon liquids are narrow cuts of isoparaffinic hydrocarbon fractions with extremely high levels of purity. They are substantially odorless, possessing a very mild paraffinic odor. They have excellent odor stability and are all manufactured by the Exxon Corporation. High-purity normal paraffinic liquids, NORPAR®12, NORPAR®13 and NORPAR®15 (Exxon Corporation) may also be used. These hydrocarbon liquids have flash points ranging from 69° C. to 118° C. All of these dispersion medium nonpolar liquids have an electrical volume resistivity in excess of $10^9$ ohm centimeters and a dielectric constant below 3.0. The vapor pressures at 25° C. are less than 10 Torr. While ISOPAR® and NORPAR® are preferred dispersant nonpolar liquids, the essential characteristics of all suitable dispersant nonpolar liquids are the electrical volume resistivity and the dielectric constant. In addition, a feature of the dispersion medium nonpolar liquids is a Kauri-butanol value less than 30, preferably in the vicinity of 27 or 28 as determined by ASTM D 1133. The ratio of thermoplastic resin to dispersion medium nonpolar liquid is such that the combination of ingredients is fluid at the working temperature. In preferred embodiments, the toner particles are present in an amount between about 0.1 to about 15% by weight, preferably 0.3 to 3.0, and more preferably a 0.5 to 2.0 weight percent with respect to the total liquid developer.

The marking particles of the present invention are essentially charge neutral when dispersed in the dispersion liquid and comprise a synthetic resin core which core is substantially insoluble in the dispersion liquid. The marking particles may contain, for example, a colorant or colorants. Suitable toners and methods of manufacturing them are disclosed in U.S. Pat. No. 5,034,299, which is hereby incorporated by reference in its entirety.

Any suitable thermoplastic resin may be used in the marking particle. The resins employed in this invention should have the preferred characteristics of being: 1) able to disperse the colorant; 2) substantially insoluble in the dispersant liquid at temperatures below 40° C. so that the resin will not dissolve or solvate in storage; 3) able to be ground to form particles between 0.1 microns and 5 microns in diameter; 4) able to form an average by area particle size of less than 10 microns, a particle size range of 0.01 to less than 10 microns, and about 30 microns average particle size; and (5) able to fuse at temperatures in excess of 70° C. An important advantage of this invention is that known commercial resins may be used without modification by incorporating a redispersion compound of the present invention into the developer formulation, such as a siloxane surfactant into the dispersion medium.

Suitable resins include, for example, poly(methyl acrylate) poly(methyl methacrylate), poly(ethyl methacrylate), poly(hydroxy-ethyl methacrylate), poly(2-ethoxyethyl methacrylate), poly(butoxy ethoxyethyl methacrylate), poly(dimethyl amino ethyl acrylate), poly (acrylic acid), poly(methacrylic acid), poly(acrylamide), poly(methacrylamide), poly(acrylonitrile), poly(vinyl chloride) and poly(ureidoethyl vinyl ether). Other useful thermoplastic resins or polymers include ethylene vinyl acetate (EVA) copolymers, ELVAX® resins from du Pont, Wilmington, Del., copolymers of ethylene and an alpha-beta ethylenically unsaturated acid selected from the group consisting of acrylic acid and methacrylic acid, copolymers of ethylene (80 to 99.9%)/acrylic or methacrylic acid (20 to 0%)/alkyl(C1 to C5) ester of methacrylic or acrylic acid (0 to 20%), polyethylene, polystyrene, isotactic polypropylene (crystalline), and ethylene ethyl acrylate series sold under the trademark BAKELITE® DPD 6169, DPDA 6182 Natural and DTDA 9169 Natural and DQDA 6832 Natural 7 from Union Carbide Corp; SURLYN® ionomer resin from du Pont, Wilmington, Del., or blends thereof, polyester, polyvinyl toluene, polyamides, styrene/butadiene copolymers and epoxy resins.

Other resins include acrylic resins, such as a copolymer of acrylic or methacrylic acid, and at least one alkyl ester of acrylic or methacrylic acid wherein alkyl is 1–20 carbon atoms, for example, methyl acrylate (50–90%)/methacrylic acid (0–20%)/ethylhexyl methacrylate (10–50%); and other acrylic resins including ELVACITE® acrylic resins, from du Pont, Wilmington, Del., or blends of resins, polystyrene, and polyethylene.

The invention also is directed to a method of preparing a liquid developer comprising a siloxane component, comprising the steps of preparing a liquid electrostatic developer base, and subsequently adding a siloxane surfactant to the developer base.

The liquid developers of the invention can be obtained from known commercial sources or can be prepared by a variety of processes commonly known in the art. For example, into a suitable mixing or blending vessel, such as an attritor, heated bail mill, heated vibratory mill such as a SWECO MILL-manufactured by Sweco Co., Los Angeles, Calif., equipped with particulate media, for dispersing and grinding, Ross double planetary mixer manufactured by Charles Ross and Son, Hauppauge, N.Y., and the like, or two roll heated mill where no particulate media is necessary, are placed at least one of the thermoplastic resin and nonpolar liquid described above. Generally, the resin, nonpolar liquid and optional colorant are placed in the vessel prior to starting the dispersing step. Optionally the colorant can be added after homogenizing the resin and the nonpolar liquid. Polar additives useful for improving transfer efficiency and enhancing image quality can also be present in the vessel, for example, up to 100% based on the weight of nonpolar liquid. The dispersing step is generally accomplished at elevated temperature, that is, the temperature of ingredients in the vessel being sufficient to plasticize and liquefy the resin but being below that at which the nonpolar liquid or polar additive, if present, degrades and the resin and or colorant decomposes. A preferred temperature range is 80° C. to 120° C. Other temperatures outside this range may be suitable, however, depending on the particular ingredients used. The presence of the irregularly moving particulate media in the vessel is preferred to prepare the dispersion of toner particles. Other stirring means can be used as well to prepare dispersed toner particles with other proper size, configuration and morphology properties. Useful particulate media include particulate materials, for example, spherical, cylindrical, and the like geometries, and comprised of various materials, such as, stainless steel, carbon steel, alumina, ceramic, zirconia, silica, and sillimanite. Carbon steel particulate media are particularly useful when colorants other than black are used. A typical diameter range for the grinding-dispersing particulate media is in the range of 0.04 to 0.5 inch or about 1.0 to about 13 mm.

After dispersing the ingredients in the vessel, with or without a polar additive present, until the desired dispersion is achieved, typically 1 hour with the mixture being fluid, the dispersion is cooled, for example, in the range of 0° to 50° C. Cooling may be accomplished, for example, in the same vessel, such as the attritor, while simultaneously grinding with particulate media to prevent the formation of a gel or solid mass; without stirring to form a gel or solid mass, followed by shredding the gel or solid mass and grinding, for example, by means of particulate media; or with stirring to form a viscous mixture and grinding by means of particulate media. Additional liquid may be added at any step during the preparation of the liquid electrostatic developer to facilitate grinding or to dilute the developer to the appropriate percent solids needed for toning. The additional liquid may be nonpolar liquid, polar additive, or combinations thereof. Cooling is accomplished by means known to those skilled in the art and is not limited to cooling by circulating cold water or a cooling material through an external cooling jacket adjacent the dispersing apparatus or permitting the dispersion to cool to ambient temperature. The resin precipitates out of the dispersant during the cooling. Toner particles of average particle size (by area) of less than 10 microns are formed by grinding for a relatively short period of time.

After cooling and separating the dispersion of toner particles from the particulate media, if present, by means known to those skilled in the art, it is possible to reduce the concentration of the toner particles in the dispersion, impart an electrostatic charge of predetermined polarity to the toner particles, or a combination of these. The concentration of the toner particles in the dispersion is reduced by the addition of additional nonpolar liquid as described previously above. The dilution is normally conducted to reduce the concentration of toner particles to a working concentration.

One or more charge director compounds may be optionally added to the dispersion medium to impart a charge. The addition may occur at any time during the process; preferably at the end of the process, for example, after the particulate media, if used, is removed and the concentration of toner particles is accomplished.

According to the method of the invention, the siloxane surfactant used as a redispersion or reconstitution compound can be added to the developer at any time after the developer has been prepared, but may be added during preparation. The surfactant remains in solution with the developer, and is combined with the toner particles of the developer in such a manner that the surfactant molecules do not react chemically with the toner particles. When the surfactant is added to the developer, it may be mixed or otherwise combined with the developer by any known method. It is a particular advantage of the invention that a developer may be prepared and stored for an indefinite period of time without surfactant, and that the surfactant may be added to the developer when the presence of surfactant is required or advantageous, such as, for example, prior to using the developer to form an image.

The resin can be a conventional liquid toner resin and can be present in a major amount of, for example, from about 80.0 to about 99.9 weight percent, and wherein the second adhesion promoting resin can be present in a minor amount of, for example, from about 1.0 to about 20.0 weight percent based on the total solids content of the liquid toner. The resin can be any conventional liquid toner resin such as acrylates, styrenes, polyesters, olefins such as poly(ethylene-propylene) copolymers, and the like materials, and mixtures thereof.

The colorant can be, for example, known pigments, dyes, and mixtures thereof. The colorant can be one or more pigments, one or more dyes, and mixtures thereof. The colorant can be a pigment, for example, carbon black, magnetite, cyan, yellow, magenta, red, green, blue, brown, orange, and the like, and mixtures thereof.

The carrier liquid can be, for example, known linear hydrocarbons with from 10 to about 40 carbon atoms, branched hydrocarbons with from 10 to about 40 carbon atoms, and mixtures thereof, such as hydrocarbons NORPAR® 15 or ISOPAR® L commercially available from Exxon Corp., in an amount of about 75 to about 99 weight percent of the total weight of the composition.

The present invention in embodiments provides a printing machine which employs the aforementioned liquid developer compositions and development processes. By way of illustration and background of liquid development and the related contact electrostatic printing process, a representative imaging system is as follows.

A contact electrostatic printing(CEP) or imaging apparatus, comprising:

a first movable member for having an electrostatic latent image formed thereon including image areas defined by a first voltage potential and non-image areas defined by a second voltage potential;

a second movable member for having a layer of liquid developing material coated thereon; and a process nip formed by operative engagement of the first movable member and the second movable member for positioning the layer of liquid developing material in pressure contact with the first movable member, wherein the electrostatic latent image on the first member generates imagewise electric fields across the layer of liquid developing material in the process nip;

the process nip being defined by a nip entrance and a nip exit, wherein the nip and the nip entrance are operative to apply compressive stress forces on the layer of liquid developing material thereat, and the nip exit is operative to apply tensile stress forces to the layer of liquid developing material for causing imagewise separation of the layer of liquid developing material thereat, for creating a developed image corresponding to the electrostatic latent image; and the layer of liquid developing material being defined by a yield stress threshold in a range sufficient to allow the layer of liquid developing material to behave substantially as a solid at the nip entrance and in the nip, while allowing the layer of liquid developing material to behave substantially as a liquid along the image/background interfaces at the nip exit.

The present invention provides a printing machine comprising: an image receiver, a liquid developer housing, and a first liquid developer composition comprising a concentrate of a mixture of a resin, a colorant, a carrier liquid, and a liquid developer reconstitution compound; wherein the housing is adapted to reclaim undeveloped developer cake from the undeveloped cake bearing liquid receiver member, and adapted to redisperse the reclaimed undeveloped developer cake into the first developer liquid. In embodiments, the printing machine can be adapted so that the developer housing redisperses the reclaimed undeveloped developer cake into a second developer liquid.

In the aforementioned liquid developer composition a preferred resin is an ethylene-methacrylic acid copolymer. A preferred pigment is carbon black. A preferred liquid carrier is a hydrocarbon, for example, an ISOPAR®.

The reconstitution promoting compound of the liquid developer is preferably chemically bonded, anchored, intimately coated on, or adhered to, to the resin particle surface, and which particles are well dispersed in the liquid carrier vehicle. In an alternative embodiment, the reconstitution promoting compound can be present in either or both the toner resin and liquid carrier phases.

The present invention provides a printing machine for printing images from liquid a developers disclosed herein. The liquid developer housing can be adapted for a variety of printing processes and machines, for example, contact electrostatic printing in an electrostatic liquid developer printing machine device or apparatus.

In embodiments the present invention provides a printing machine comprising a the liquid developer housing, a liquid developer receiver member, an intermediate transfer member, a liquid carrier removal member, and a liquid developer composition comprising: a resin or resins, a colorant, a liquid carrier vehicle, and a reconstitution promoting compound as described and illustrated herein.

The invention will further be illustrated in the following non limiting Examples, it being understood that these Examples are intended to be illustrative only and that the invention is not intended to be limited to the materials, conditions, process parameters, and the like, recited herein. Parts and percentages are by weight unless otherwise indicated.

EXAMPLE I

PREPARATION OF LIQUID DEVELOPER WITH A RECONSTITUTION PROMOTING COMPOUND One hundred sixty point four (160.4) grams of NUCREL RX-76®, a copolymer of ethylene and methacrylic acid with a melt index of about 800, available from E.I. DuPont de Nemours & Company, Wilmington, Del., 2.0 grams of Alohas(as defined below) powder and 405 grams of ISOPAR-M® from Exxon Corporation, were added to a Union Process 1S attritor(Union Process Company, Akron, Ohio) charged with 0.1857 inch (4.76 millimeters) diameter carbon steel balls. The mixture was milled in the attritor, which was heated with running steam through the attritor jacket to about 80° C. to 115° C. for 15 minutes. Next, 107.6 grams of the magenta pigment(Sun Rhodamine Y 18:3) from Sun Chemicals was added to the attritor. The resulting mixture was milled in the attritor, which was maintained at 80° C. to 115° C. for 2 hours with running steam through the attritor jacket. 675 Grams of ISOPAR-M® were added to the attritor at the conclusion of 2 hours, and cooled to 23° C. by running water through the attritor jacket, and the contents of the attritor were ground for an additional 4 hours. About 600 grams of additional ISOPAR-M® was added and the mixture was separated from the steel balls.

The liquid developer solids content consists of a mixture of 40 percent by weight of Rhodamine Y magenta pigment; 0.7 percent by weight Alohas as charge acceptance agent bound to the toner resin, and 59.3 percent by weight NUCREL RX-76® toner resin. The liquid developer solids content is 13.313 percent by weight and the ISOPAR-M® level is 86.687 percent by weight. To a 100 gram sample of the above mixture from the attritor (13.313 percent solids) was added 66.4 gram of ISOPAR-M® and 0.62 gram of poly(ethylene oxide-g-dimethyl siloxane) reconstitution promoting compound with a 5 weight percent of ethylene oxide in the graft copolymer. The mixture was then roll milled with 3/16' steel shots for four hours to provide a working developer with 8% toner solids and 0.37% poly (ethylene oxide-g-dimethyl siloxane) reconstitution promoting compound. The developer was used in liquid development and the undeveloped cake portion was reclaimed and redispersed in liquid carrier or liquid developer to form reclaimed liquid developer that was suitable for liquid redevelopment.

Alohas is hydroxy bis (3,5-di-tertiary butyl salicyclic) aluminate monohydrate, reference for example U.S. Pat. Nos. 5,366,840 and 5,324,613, the disclosures of which are totally incorporated herein by reference.

EXAMPLE II

Example I was repeated with the exception that the aforementioned 0.62 gram (0.37%) poly(ethylene oxide-g-dimethyl siloxane) reconstitution promoting compound was substituted with a different reconstitution compound, 6.2 grams (3.7% by weight) of an amine-terminated poly (dimethyl siloxane), with the result that the resulting undeveloped developer cake after being reclaimed was readily redispersed into a working developer formulation.

EXAMPLE III

One hundred forty six point two (146.2) grams of NUCREL RX-76®, a copolymer of ethylene and methacrylic acid with a melt index of about 800, available from E.I. DuPont de Nemours & Company, Wilmington, Del., and 405 grams of ISOPAR-M® (Exxon Corporation) were added to a Union Process 1 S attritor (Union Process Company, Akron, Ohio) charged with 0.1857 inch (4.76 millimeters) diameter carbon steel balls. The mixture was milled in the attritor, which was heated with running steam through the attritor jacket to about 80° C. to 115° C. for 15 minutes. Next, 107.6 grams of the magenta pigment (Sun Rhodamine Y 18:3) available from Sun Chemicals, and 16.2 grams of a reconstitution promoting compound ELVAX 200W, available from E.I. DuPont de Nemours & Company, as added to the attritor. The resulting mixture was milled in the attritor, which was maintained at 80° C. to 115° C. for 2 hours with running steam through the attritor jacket. 675 Grams of ISOPAR-M® were added to the attritor at the conclusion of 2 hours, and cooled to 23° C. by running water through the attritor jacket, and the contents of the attritor were ground for an additional 4 hours. Additional ISOPAR-M®, about 600 grams, was added and the mixture was separated from the steel balls.

The liquid developer solids contain 40 percent by weight of Rhodamine Y magenta pigment; 6% ELVAX 200W reconstitution promoting compound and 54 percent NUCREL RX-76® toner resin. The solids level was 12.873 percent and the ISOPAR M level was 87.127 percent of this developer.

To a 100 gram sample of the above mixture from the attritor (12.873 percent solids) was added 60.9 grams of ISOPAR-M®. The resulting mixture formed a working liquid developer containing about 8% toner solids with ELVAX 200W reconstitution promoting compound, and showed that the resulting reclaimed undeveloped cake could be redispersed into neat liquid carrier to form a reclaimed liquid developer or readily dispersed into a working developer formulation.

EXAMPLE IV

Example I was repeated with the exception that the aforementioned reconstitution promoting compound was substituted with a different reconstitution compound of about 22 weight percent SOLSPERSE 17000, available from Avecia (formerly Zeneca) and showed that the resulting reclaimed undeveloped cake could be redispersed into neat liquid carrier to form a reclaimed liquid developer or readily dispersed into a working developer formulation.

COMPARATIVE EXAMPLE I

PREPARATION OF LIQUID DEVELOPER WITHOUT A RECONSTITUTION PROMOTING COMPOUND

Example I was repeated with the exception that the aforementioned reconstitution promoting compound was omitted from the formulation with the result that the resulting reclaimed undeveloped developer cake was difficult to redisperse into either neat liquid carrier or a working developer formulation.

Other modifications of the present invention may occur to one of ordinary skill in the art based upon a review of the present application and these modifications, including equivalents thereof, are intended to be included within the scope of the present invention.

What is claimed is:

1. A process comprising:

dispersing a first liquid developer concentrate comprising a resin, a colorant, and a liquid developer reconstitution compound, in a carrier liquid, into additional carrier liquid to form a second liquid developer;

depositing the second liquid developer onto a liquid receiver member to form a developer cake;

developing an image with the developer cake;

reclaiming undeveloped developer cake from the cake bearing liquid receiver member; and redispersing the reclaimed undeveloped developer cake in the second developer liquid and wherein the reclaimed undeveloped cake is kept separated from the second liquid developer until the solids content of the second liquid developer drops below from about 6 to about 10 weight percent.

2. A process in accordance with claim 1, further comprising wherein the developer cake on the liquid receiver member is charged by a corona charger prior to developing the image.

3. A process in accordance with claim 1, wherein the second liquid developer is dielectric with a conductivity of from about 0.01 to about 5 pS/cm.

4. A process in accordance with claim 1, further comprising continuously measuring the solids content or solids concentration of the second liquid developer in a developer sump.

5. A process in accordance with claim 1, further the developed image to a receiver substrate.

6. A process in accordance with claim 1, wherein the reclaimed developer cake is combined directly with the second liquid developer.

* * * * *